US009460627B2

(12) United States Patent
Minemura et al.

(10) Patent No.: US 9,460,627 B2
(45) Date of Patent: Oct. 4, 2016

(54) COLLISION DETERMINATION DEVICE AND COLLISION MITIGATION DEVICE

(71) Applicant: DENSO CORPORATION, Kariya, Aichi (JP)

(72) Inventors: Akitoshi Minemura, Nishio (JP); Akira Isogai, Kuwana (JP); Yoshihisa Ogata, Chiryu (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 92 days.

(21) Appl. No.: 14/259,505

(22) Filed: Apr. 23, 2014

(65) Prior Publication Data

US 2014/0324330 A1 Oct. 30, 2014

(30) Foreign Application Priority Data

Apr. 26, 2013 (JP) ..... 2013-093819

(51) Int. Cl.
*G08G 1/16* (2006.01)

(52) U.S. Cl.
CPC ..... *G08G 1/166* (2013.01); *G08G 1/16* (2013.01)

(58) Field of Classification Search
CPC ..... G08G 1/166; G08G 1/16
See application file for complete search history.

(56) References Cited

U.S. PATENT DOCUMENTS

2009/0303026 A1* 12/2009 Broggi ..... G01S 17/023 340/435

FOREIGN PATENT DOCUMENTS

| | | |
|---|---|---|
| EP | 2400473 | 12/2011 |
| JP | 2005-228127 | 8/2005 |
| JP | 2005-280538 | 10/2005 |
| JP | 2006-284293 | 10/2006 |
| JP | 2009-257981 | 11/2009 |
| JP | 2011-116218 | 6/2011 |
| JP | 2012-093883 | 5/2012 |
| WO | 2012/172632 | 12/2012 |

* cited by examiner

*Primary Examiner* — John Q Nguyen
*Assistant Examiner* — Michael Kerrigan
(74) *Attorney, Agent, or Firm* — Harness, Dickey & Pierce, P.L.C.

(57) ABSTRACT

A collision determination device is mounted to an own vehicle and determines a probability of a collision with a moving object. The collision determination device determines whether or not an own vehicle will collide with a moving object that is detected within a captured image. The collision determination device determines whether or not the moving object is in a shielded state where at least a portion of the moving object is hidden behind another object or the moving object appears from behind another object. The collision determination device sets an amount of time required for the collision determining means to complete a determination related to the collision to a shorter amount of time when the moving object is in the shielded state, compared to when the moving object is not in the shielded state.

22 Claims, 7 Drawing Sheets

COLLISION DETERMINATION DEVICE AND COLLISION MITIGATION DEVICE

CROSS-REFERENCE TO RELATED APPLICATION

This application is based on and claims the benefit of priority from Japanese Patent Application No. 2013-093819, filed Apr. 26, 2013, the disclosure of which is incorporated herein in its entirety by reference.

BACKGROUND

1. Technical Field

The present invention relates to a collision determination device and a collision mitigation device that are mounted to an own vehicle, in which the collision determination device determines the probability of a collision with a moving object.

2. Related Art

As the above-described collision determination device, a configuration is known in which a warning is issued when a pedestrian walking behind a vehicle is detected (for example, refer to JP-B-4313712).

In the collision determination device, the probability of a collision between a target object, such as a pedestrian, and the own vehicle is required to be determined at an early stage. However, unless the probability of a collision is accurately determined, erroneous operations, such as false alarms, increase and cause confusion. Therefore, false alarms are suppressed by time being taken to perform a collision determination in which the movement trajectory of the target object is accurately calculated.

Here, in the above-described collision determination device in JP-B-4313712, the collision determination is expected to be favorably performed in instances in which the pedestrian walking behind a vehicle is visible. However, time is required for the collision determination, as described above. Therefore, the determination may not be made in time in instances in which the target object suddenly appears from behind a shielding object, such as a vehicle.

SUMMARY

It is thus desired to provide a collision determination device and a collision mitigation device that are mounted to an own vehicle, in which the collision determination device detects the probability of a collision with a moving object, and is capable of detecting, at an earlier stage, a target object that appears from behind a shielding object, while minimizing false alarms.

An exemplary embodiment provides a collision determination device that is mounted to an own vehicle and determines a probability of a collision of the own vehicle with a moving object. The collision determination device includes collision determining means, shielding determining means, and setting changing means. The collision determining means determines whether or not an own vehicle will collide with a moving object that is detected within a captured image. The shielding determining means determines whether or not the moving object is in a shielded state in which at least a portion of the moving object is hidden behind another object or the moving object appears from behind another object. The setting changing means sets an amount of time required for the collision determining means to complete a determination related to the collision to a shorter amount of time when the moving object is in the shielded state, compared to when the moving object is not in the shielded state.

According to a collision determining device such as this, when the moving object is in the shielded state, the amount of time required until the determination related to a collision with the moving object is completed can be shortened. Therefore, whether or not a collision will occur can be determined at an earlier stage. On the other hand, when the moving object is not in the shielded state, a longer amount of time is taken to determine collision compared to when the moving object is in the shielded state. Therefore, erroneous determination can be suppressed.

DESCRIPTION OF THE EMBODIMENTS

A collision determination device and a collision mitigation device according to an embodiment will hereinafter be described with reference to the drawings.

Figure 1:
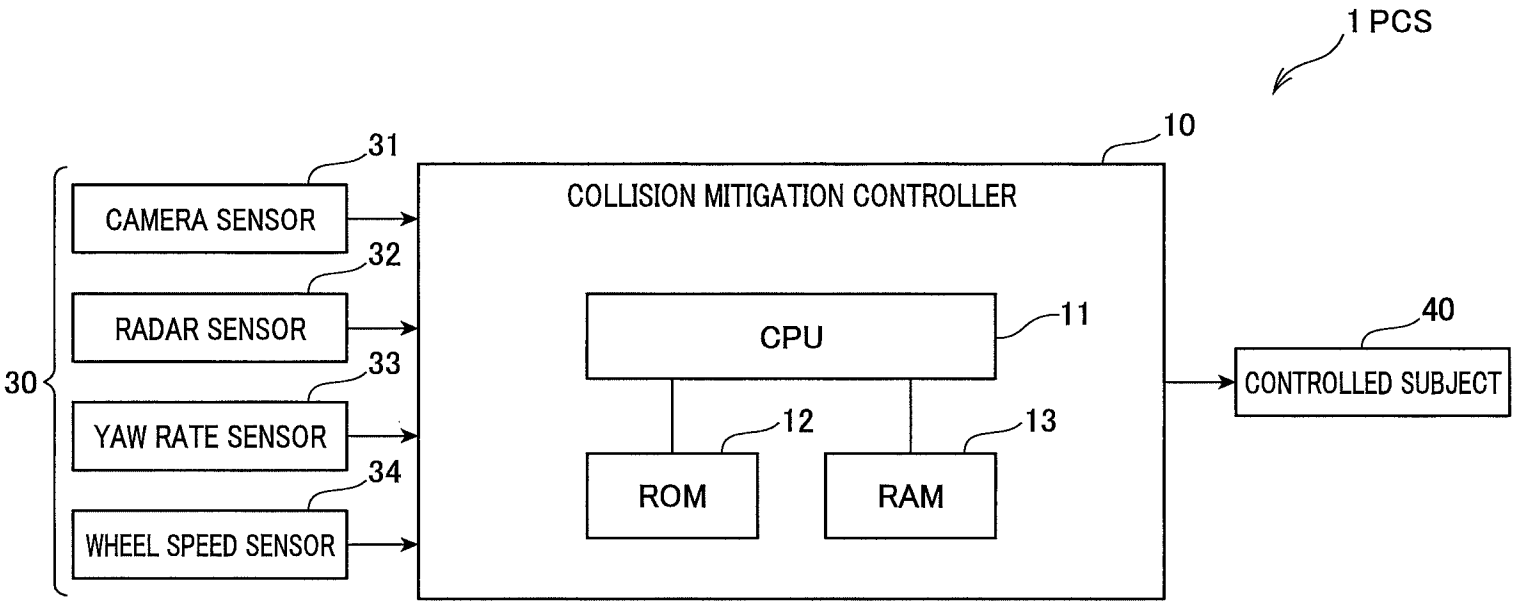
FIG. 1 is a block diagram of an overall configuration of a pre-crash safety system to which a collision mitigation device according to an embodiment is applied.

As shown in FIG. 1, the collision mitigation device of the present embodiment is applied to a pre-crash safety system (hereinafter referred to as PCS) 1. This PCS 1 is a system that is installed in a vehicle, such as a passenger car. For example, the PCS 1 detects the risk of a collision of the vehicle and suppresses collision of the vehicle. In addition, upon collision of the vehicle, the PCS 1 mitigates damage from the collision. Specifically, as shown in FIG. 1, the PCS 1 includes a collision mitigation controller 10, various sensors 30, and a controlled subject 40. The collision determination device of the present embodiment is applied to the collision mitigation controller 10.

The various sensors 30 include, for example, a camera sensor 31, a radar sensor 32, a yaw rate sensor 33, and a wheel speed sensor 34. The camera sensor 31 is configured, for example, as a stereo camera that is capable of detecting the distance to a target object. The camera sensor 31 recognizes the shape of the target object and the distance to the target object based on captured images. The target object is, for example, a pedestrian, an on-road obstruction, or another vehicle that is captured in the images.

The radar sensor 32 detects a target object and the position of the target object (relative position to the own vehicle). The yaw rate sensor 33 is configured as a known yaw rate sensor that detects the yaw rate of the vehicle.

The wheel speed sensor 34 detects the rotation frequency of the wheels, or in other words, the traveling speed of the vehicle. The detection results from the various sensors 30 are acquired by the collision mitigation controller 10.

The camera sensor 31 and the radar sensor 32 detect target objects positioned in the traveling direction of the vehicle at a predetermined interval (such as 100 ms) set in advance. In addition, the radar sensor 32 also detects the shape and size of the target object by emitting electromagnetic waves which have directivity to the target object and receiving reflection waves of the emitted electromagnetic waves.

The collision mitigation controller 10 is configured as a known computer. The computer includes a central processing unit (CPU) 11, a read-only memory (ROM) 12, a random access memory (RAM) 13, and the like. The collision mitigation controller 10 runs a program that is stored in the ROM 12, based on the detection results from the various sensors 30 and the like. The collision mitigation controller 10 thereby performs various processes, such as a collision mitigation process, described hereafter.

The collision mitigation controller 10 performs such processes and operates the controlled subject 40 based on the processing results of the processes. The controlled subject 40 includes, for example, an actuator that drives a braking, a steering, a seatbelt or the like, and a warning device that issues a warning. According to the present embodiment, an instance in which the controlled subject 40 is the braking will be described hereafter.

As described above, when the CPU 11 actuates function of an automatic braking, the CPU 11 actuates the controlled subject 40 to achieve a deceleration rate and a deceleration amount (the difference in speed before and after actuation of automatic braking) set in advance, based on a detection signal from the wheel speed sensor 34.

Next, the collision mitigation process will be described with reference to FIG. 2 and subsequent drawings. The collision mitigation process is performed when an automatic braking is performed. The collision mitigation process is started at a predetermined interval (such as about 50 ms) set in advance.

Figure 2:
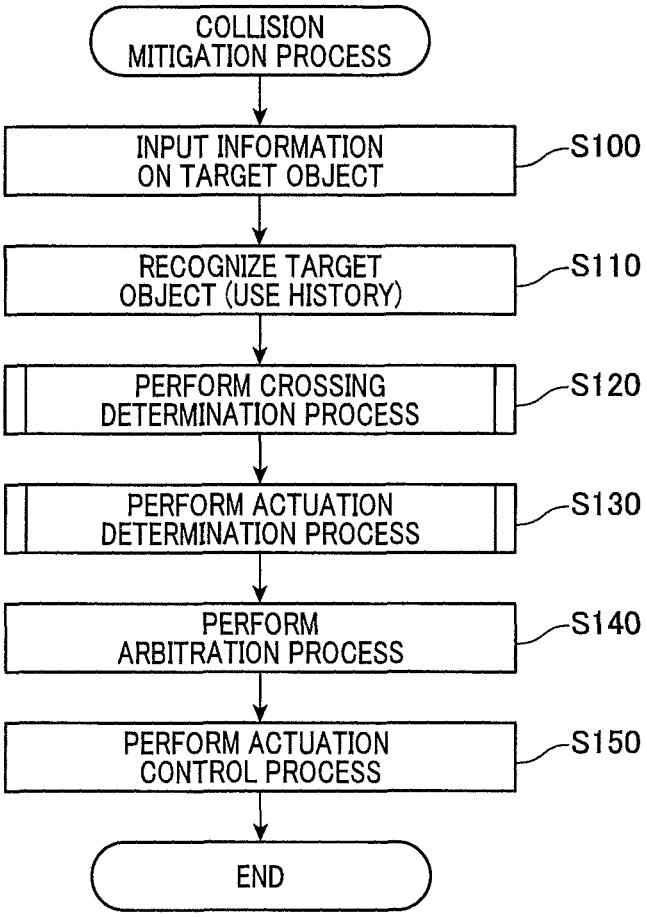
FIG. 2 is a flowchart of a collision mitigation process performed by a central processing unit (CPU) of a collision mitigation controller.

Specifically, as shown in FIG. 2, in the collision mitigation process, first, the CPU 11 of the collision mitigation controller 10 inputs information on a target object (step S100). In this processing operation, the CPU 11 acquires the latest information on the position of the target object detected by the camera sensor 31 and the radar sensor 32.

Then, the CPU 11 performs recognition of the target object (step S110). In this processing operation, the type of target object (such as a vehicle, a pedestrian, a bicycle, or a motorcycle) is recognized based on the shape and the like of the target object acquired from the camera sensor 31 (such as by pattern matching). A target object that has been previously recorded in the RAM 13 or the like and the target object that is recognized at this time are then associated.

Next, the CPU 11 performs a crossing determination process (step S120). In the crossing determination process, whether or not a moving object will cross in front of the own vehicle in the traveling direction is estimated.

Figure 3:
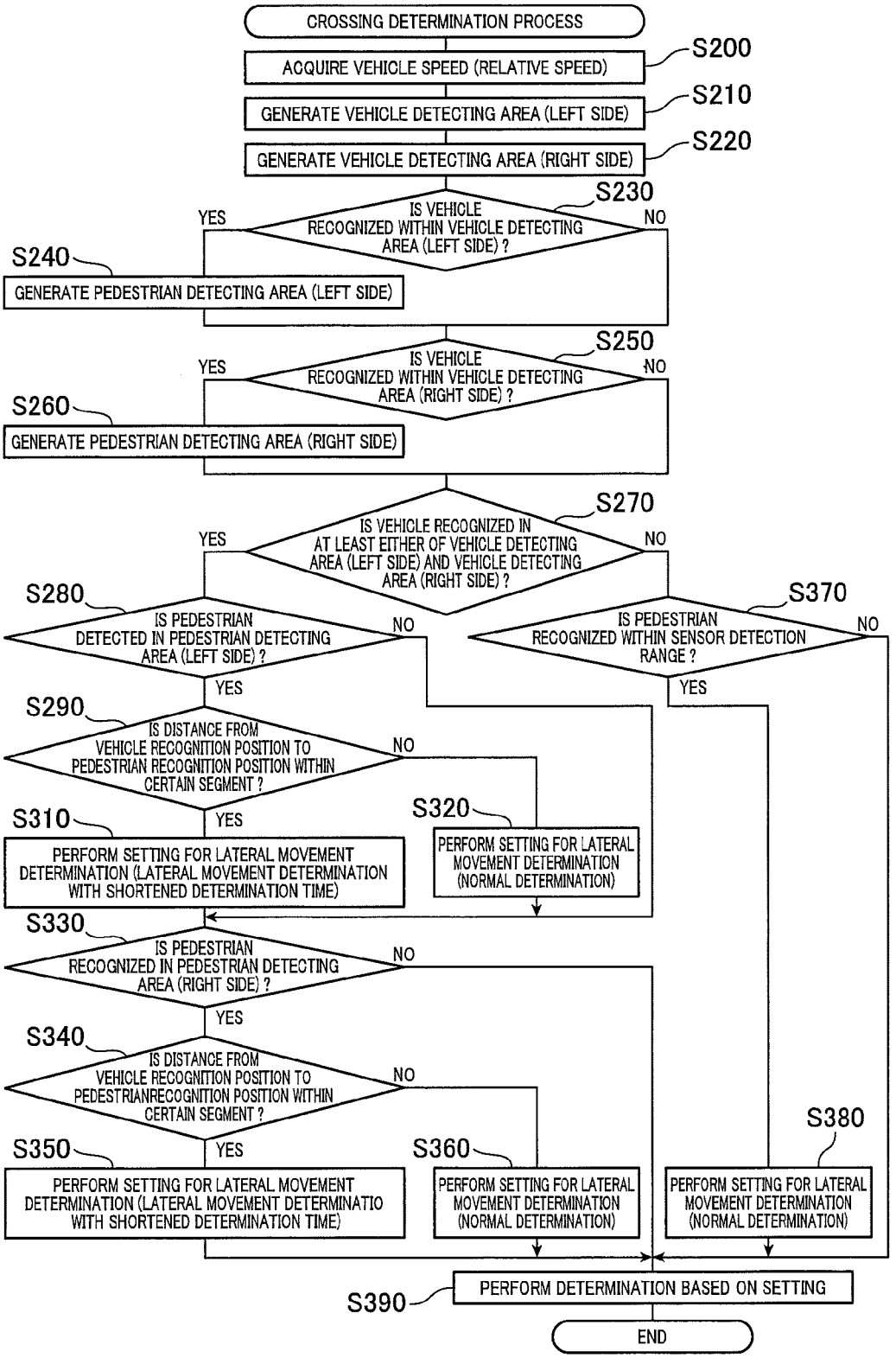
FIG. 3 is a flowchart of a crossing determination process in the collision mitigation process shown in FIG. 2.

As shown in FIG. 3, in the crossing determination process, first, the CPU 11 acquires the vehicle speed and the relative speed to the target object (step S200). The relative speed can be determined from the Doppler Effect that occurs when the radar sensor 32 detects the target object, or from the position history of the target object (relative movement trajectory).

Figure 4:
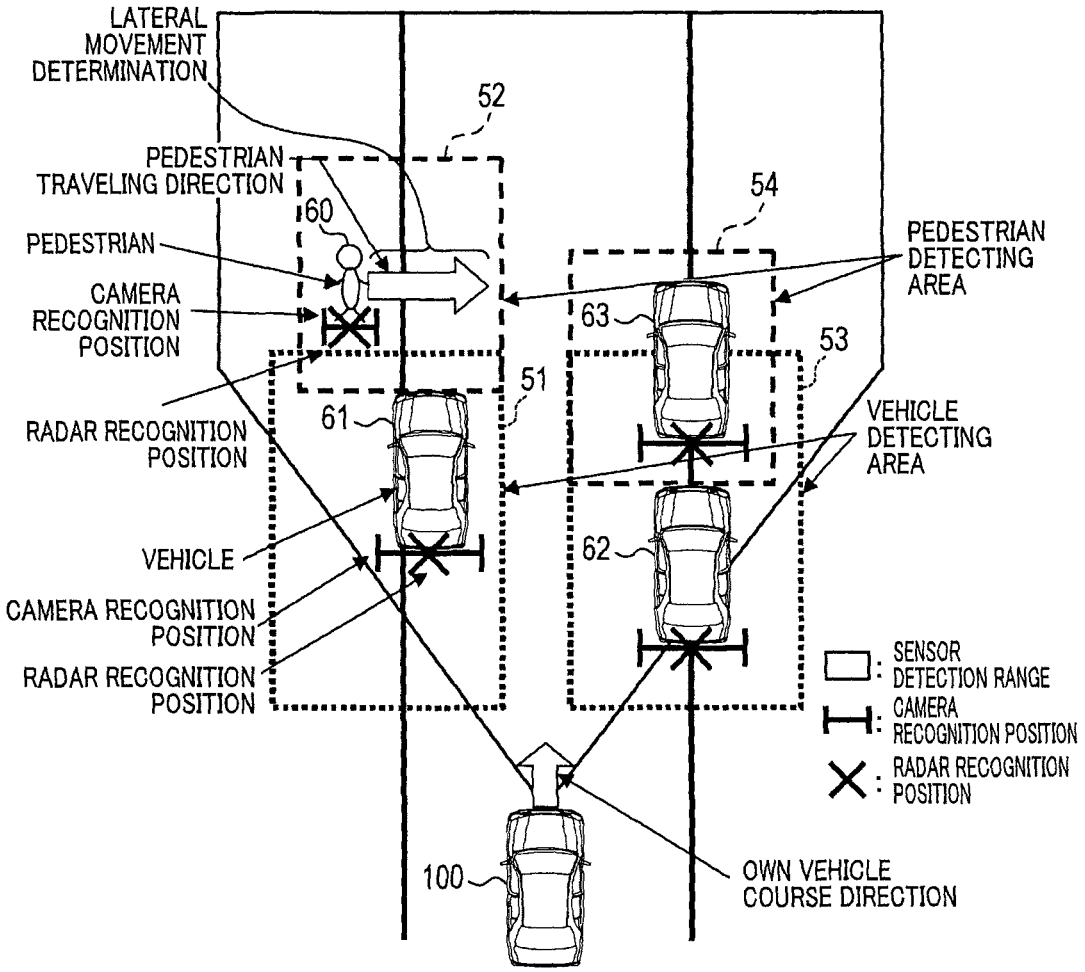
FIG. 4 is a bird's-eye view of vehicle detecting areas and pedestrian detecting areas according to the embodiment.

Next, the CPU 11 sets two areas on the left side and the right side ahead of the own vehicle as vehicle detecting areas (corresponding to at least one specific area) (steps S210 and S220). In this processing operation, as shown in FIG. 4, the vehicle detecting areas (corresponding to a left side specific area and a right side specific area) 51 and 53 are set in areas in which stopped vehicles 61 to 63 are assumed to be present, in the traveling direction (ahead) of an own vehicle 100. The vehicle detecting areas 51 and 53 are separated into areas on the left side and the right side.

The positions and sizes of the vehicle detecting areas 51 and 53 are set based on the traveling speed of the own vehicle or the relative speed to the stopped vehicles 61 to 63 (shielding objects). For example, in an instance in which the traveling speed or the relative speed is 20 km/h, the position of each vehicle detecting area 51 and 53 is set to a position (size being 10 m in depth) that is 5 m to 15 m from the own vehicle 100. As the traveling speed or the relative speed increases, the position of each vehicle detecting area 51 and 53 becomes farther away from the own vehicle 100. In addition, the size (depth) of each vehicle detecting area 51 and 53 becomes larger.

Next, the CPU 11 judges whether or not a stopped vehicle is recognized in the vehicle detecting area 51 on the left side (step S230). The stopped vehicle is a vehicle that is moving at a speed at which the vehicle can be considered stopped (for example, a vehicle of which the moving speed is from +20 km/h to less than −20 km/h, or is moving at a very slow speed; the moving speed here refers to absolute speed). When judged that a stopped vehicle is not recognized in the vehicle detecting area 51 on the left side (NO at step S230), the CPU 11 proceeds to step S250.

When judged that a stopped vehicle is recognized in the vehicle detecting area 51 on the left side (YES at step S230), the CPU 11 generates a pedestrian detecting area (corresponding to at least one moving object extracting area) 52 on the left side in the traveling direction of the own vehicle (step S240). Here, the pedestrian detecting area 52 is set to an area in which field of view is estimated to be shielded by the stopped vehicle. The pedestrian detecting area 52 is set further towards the depth direction in the captured image than the vehicle detecting area 51 in which the stopped vehicle has been recognized.

The pedestrian detecting area 52 is set such that the starting point is a position moved further towards the depth direction by a distance amounting to the length of the vehicle, with reference to the position of the stopped vehicle (recognition position). The position at the end point in the depth direction (size of the pedestrian detecting area 52) is set depending on the traveling speed of the own vehicle or the relative speed to the pedestrian. In a manner similar to the vehicle detecting area 51 and 53, the pedestrian detecting area 52 is also set such as to become larger as the traveling speed of the own vehicle or the relative speed to the pedestrian increases.

Next, the CPU 11 judges whether or not a stopped vehicle is recognized in the vehicle detecting area 53 on the right side (step S250). When judged that a stopped vehicle is not recognized in the vehicle detecting area 53 on the right side (NO at step S250), the CPU 11 proceeds to step S270.

When judged that a stopped vehicle is recognized in vehicle detecting area 53 on the right side (YES at step S250), the CPU 11 generates a pedestrian detecting area 54 on the right side (step S260). In this processing operation, a processing operation similar to that for generating the pedestrian detecting area 52 on the left side is performed.

As a result of the processing operations at steps S230 to S260 being performed in this way, when a stopped vehicle is recognized in the vehicle detecting area 51 on the left side, the pedestrian detecting area 52 is set on the left side in the traveling direction of the own vehicle. When a stopped vehicle is recognized in the vehicle detecting area 53 on the right side, the pedestrian detecting area 54 is set on the right side in the traveling direction of the own vehicle.

In addition, it can be said that a pedestrian 60 that is present in the pedestrian detecting area 52 or 54 is in a shielded state. In the shielded state, at least a portion of the pedestrian 60 is hidden behind the stopped vehicle. Alternatively, the pedestrian 60 has appeared from behind the stopped vehicle.

According to the present embodiment, when the plurality of stopped vehicles 62 and 63 (see FIG. 4) is recognized in the vehicle detecting areas 51 and 53, the pedestrian detecting areas 52 and 54 are set with reference to the position of the stopped vehicle 62 that is closest to the own vehicle, of the stopped vehicles 62 and 63. Once the pedestrian detecting areas 52 and 54 are set, the pedestrian detecting areas 52 and 54 remain set until the own vehicle passes directly beside the pedestrian detecting areas 52 and 54 (until the own vehicle moves by a distance from the position at which the pedestrian detecting areas 52 and 54 are set to the position of the end point in the depth direction [moving object extracted distance]).

Next, the CPU 11 judges whether or not a stopped vehicle is recognized in at least either of the vehicle detecting areas 51 and 53 on the left side and the right side (step S270). When judged that a stopped vehicle is recognized (YES at step S270), the CPU 11 judges whether or not a pedestrian is recognized in the pedestrian detecting area 52 on the left side (step S280). When judged that a pedestrian is not recognized (NO at step S280), the CPU 11 proceeds to step S330, described hereafter.

When judged that a pedestrian is recognized (YES at step S280), the CPU 11 judges whether or not a distance from the position at which the stopped vehicle is recognized to the position at which the pedestrian is recognized is within a reference distance set in advance (a distance used to recognize a pedestrian that, in the shielded state, is close to the stopped vehicle and has a higher risk) (step S290).

When judged that the distance from the position at which the stopped vehicle is recognized to the position at which the pedestrian is recognized is within the reference distance (YES at step S290), the CPU 11 shortens the amount of time required for performing a lateral movement determination (determination of whether or not the pedestrian will cross in front of the own vehicle) of the pedestrian (step S310).

Specifically, the amount of time required until the completion of the determination related to collision is set to a short amount of time by a reference condition being relaxed. The reference condition is used when determining a collision. The reference condition indicates, for example, the number of images (number of frames) used when determining the trajectory of a moving object, the movement distance (absolute value) in the lateral direction of a moving object, and the like.

In the instance in which the reference condition is the number of images, relaxing the reference condition refers to reducing the number of images. In the instance in which the reference condition is the movement distance, relaxing the reference condition refers to reducing the value of the distance. As a result, the lateral movement determination is completed at an earlier stage.

When the reference condition is changed during this processing operation, the reference condition becomes more relaxed as the distance in the lateral direction from the position of the own vehicle to the position of the detected moving object becomes smaller. For example, as shown in FIG. 4, focusing on the distance in the width direction of the own vehicle 100, the distance in the width direction from the own vehicle 100 to the stopped vehicles 62 and 63 on the right side is greater than the distance in the width direction from the own vehicle 100 to the stopped vehicle 61 on the left side.

In this situation, the reference condition is more relaxed regarding the pedestrian 60 that appears from behind the stopped vehicle 61. The distance in the width direction of this pedestrian 60 is closer than that of a pedestrian that appears from behind the stopped vehicle 62.

Figure 5:
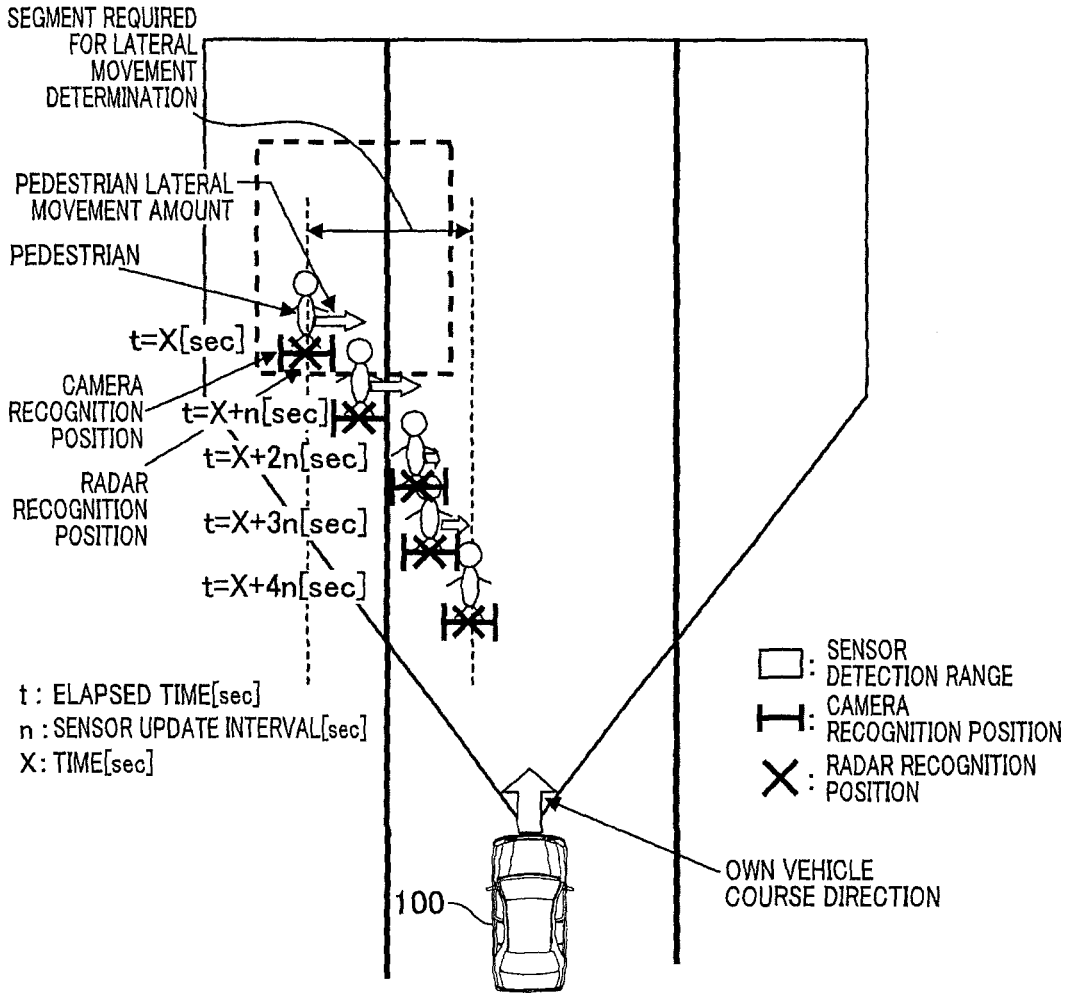
FIG. 5 is a bird's-eye view of an example of the movement trajectory of a pedestrian.

Here, to determine the amount of lateral movement of the moving object, as shown in FIG. 5, the movement trajectory of the pedestrian in relation to the own vehicle 100 is used. In the example shown in FIG. 5, images amounting to five frames from t=X to (X+4 n) is used to more accurately determine the movement amount of the moving object. However, when the reference condition is relaxed, for example, images amounting to three frames from t=X to (X+2 n) may be used.

Next, at step S290, when judged that the distance from the position at which the stopped vehicle is recognized to the position at which the pedestrian is recognized is not within the reference distance (NO at step S290), the CPU 11 sets the lateral movement determination of the pedestrian to an ordinary state in which the amount of time required to perform the lateral movement determination is not shortened (step S320).

Then, the CPU 11 performs processing operations similar to the processing operations (steps S280 to S320) for the pedestrian detecting area 53 on the left side, for the pedestrian detecting area 54 on the right side (steps S330 to S360). When such processing operations are completed, the CPU 11 proceeds to step S390, described hereafter.

When judged that a stopped vehicle is not recognized at step S270 (NO at step S270), the CPU 11 judges whether or not a pedestrian is recognized within the detection range of each sensor (step S370). When judged that a pedestrian is recognized (YES at step S370), the CPU 11 sets the lateral movement determination of the pedestrian to an ordinary state in which the amount of time required to perform the lateral movement determination is not shortened (step S380). The CPU 11 then proceeds to step S390.

When judged that a pedestrian is not recognized (NO at step S370), the CPU 11 proceeds to step S390. At step S390, the CPU 11 performs crossing determination based on the setting (step S390). As the threshold (reference condition) and the like used to perform the crossing determination, the setting in which the required time is shortened, the ordinary state setting in which the required time is not shortened, and the like are used.

Then, whether or not the pedestrian detected the captured image will cross in front of the own vehicle is determined based on whether or not a parameter value (such as the relative speed, the relative distance, or the amount of lateral movement) related to the positional relationship between the pedestrian and the own vehicle meets the reference condition set in advance.

When such processing operations are completed, the CPU 11 continues the processing flow in FIG. 2 and performs an actuation determination process (step S130). In the actuation determination process, whether or not it is time to actuate the controlled subject 40 is determined based on a presumed traveling course of the target object, the distance to the target object, the relative speed to the target object, and the like.

When it is time to actuate the controlled subject 40, an actuation instruction is generated and recorded in the RAM 13.

Figure 6:
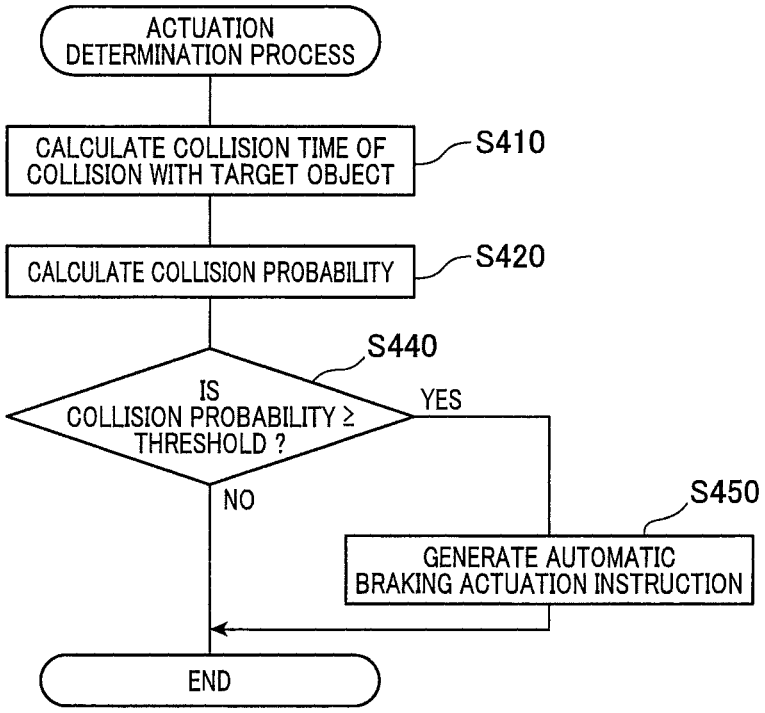
FIG. 6 is a flowchart of an actuation determination process in the collision mitigation process shown in FIG. 2.

In the actuation determination process, as shown in FIG. 6, the CPU 11 calculates a collision time based on the behavior of the target object and the relative speed to the target object (step S410). The collision time indicates the amount of time until the own vehicle and the target object collide.

Then, the CPU 11 calculates collision probability (step S420). The collision probability indicates the probability of a collision between the own vehicle and the target object. Here, for the collision probability, numerous correction coefficients are calculated based on the above-described crossing determination result, collision time, speed of the moving object, speed of the own vehicle or relative speed, positional relationship, and the like.

The collision probability is then derived by a calculation being performed using the correction coefficients. The collision probability is set to a higher value when determined that the pedestrian will cross in front of the vehicle based on the crossing determination result, compared to when determined that the pedestrian will not cross in front of the own vehicle.

Then, the CPU 11 compares the collision probability with a threshold set in advance (step S440). When judged that the collision probability is the threshold or higher (YES at step S440), the CPU 11 generates an automatic braking actuation instruction (in other words, sets a flag in the RAM 13) (step S450). The CPU 11 then ends the actuation determination process.

When judged that the collision probability is less than the threshold (YES at step S440), the CPU 11 ends the actuation determination process. When the actuation determination process is completed, the CPU 11 continues to the processing flow in FIG. 2 and performs an arbitration process (step S140).

In the arbitration process, whether or not to actually actuate the controlled subject 40 is ultimately determined. Specifically, in an instance in which the actuation instruction for automatic braking is recorded in the RAM 13 in the actuation determination process, if the driver performs a collision avoidance maneuver and there is sufficient leeway until collision with the target object, it is considered that the driver themselves has performed collision avoidance.

Therefore, actuation of automatic braking is prohibited. In other words, in the arbitration process, driver operation is prioritized when the collision can be avoided. Actuation of automatic braking may be cancelled.

Next, the CPU 11 performs an actuation control process (step S150). In the actuation control process, the CPU 11 transmits to the controlled subject 40 the actuation instruction corresponding to the controlled subject 40 (to the respective controlled subjects 40 if a plurality of controlled subjects 40 are present) based on the generated actuation instruction (flag).

When such actuation control process is completed, the collision mitigation process is completed.

In the PCS 1, described in detail above, the collision mitigation controller 10 estimates the probability of a collision between the own vehicle and the target object. When the probability of a collision is higher than a predetermined threshold, the collision mitigation controller 10 actuates an actuator to avoid collision. In addition, the collision mitigation controller 10 determines whether or not the own vehicle will collide with a moving object (pedestrian) detected within a captured image.

Then, whether or not the moving object is a shielded state is determined. In the shielded state, at least a portion of the moving object is hidden behind another object. Alternatively, the moving object appears from behind the other object. Furthermore, the collision mitigation controller 10 sets the amount of time required until the determination related to collision (the crossing determination process according to the present embodiment, but may be other processes) is completed to a shorter amount of time when the moving object is in the shielded state, compared to when the moving object is not in a shielded state.

According to the PCS 1 such as this, when the moving object is in the shielded state, the amount of time required until the determination related to collision with the moving object is completed can be shortened. Therefore, whether or not a collision will occur can be determined at an earlier stage. On the other hand, when the moving object is not in the shielded state, a longer amount of time is taken to determine collision, compared to when the moving object is in the shielded state. Therefore, erroneous determination can be suppressed.

In addition, in the above-described PCS 1, the collision mitigation controller 10 judges whether or not the own vehicle will collide with a moving object detected in a captured image by determining whether or not a parameter value related to the positional relationship between the moving object and the own vehicle meets a reference condition set in advance. The collision mitigation controller 10 relaxes the reference condition used to determine collision, thereby setting the amount of time required until the determination related to collision is completed to a short amount of time.

According to the PCS 1 such as this, the reference condition is relaxed. Therefore, the parameter value related to the positional relationship between the moving object and the own vehicle can more easily meet the reference condition at an earlier stage. Therefore, the amount of time required until the determination related to collision is completed can be shortened.

Furthermore, in the above-described PCS 1, the collision mitigation controller 10 extracts a shielding object that may shield the moving object and is positioned within the vehicle detecting areas 51 and 53.

The vehicle detecting areas 51 and 53 are set as some areas in the captured image. Then, the collision mitigation controller 10 sets the pedestrian detecting areas 52 and 54 to areas in which the field of view is estimated to be shielded by the shielding object.

The pedestrian detecting areas 52 and 54 are set further towards the depth direction in the captured image than the vehicle detecting areas 51 and 53 from which the shielding object has been extracted. Furthermore, when the moving object is detected in the pedestrian detecting areas 52 and 54, the moving object is determined to be in the shielded state.

According to the PCS 1 such as this, the moving object is determined to be in the shielded state when the moving object is detected in the pedestrian detecting areas 52 and 54. Therefore, whether or not the moving object is in the shielded state can be easily determined.

In addition, in the above-described PCS 1, the collision mitigation controller 10 determines that the moving object is in the shielded state when the moving object is detected in the pedestrian detecting areas 52 and 54 during a period from when the shielding object is extracted until the own vehicle moves by the moving object extracted distance set in advance.

According to the PCS 1 such as this, even when the pedestrian detecting areas 52 and 54 move with the elapse of time, the pedestrian detecting areas 52 and 54 set in the past can be maintained until the own vehicle moves by the moving object extracted distance. Therefore, collision determination can be quickly performed regarding the moving object detected in this area.

Furthermore, in the above-described PCS 1, the collision mitigation controller 10 sets the positions and the sizes of the vehicle detecting area 51 and 53 based on the traveling speed of the own vehicle or the relative speed to the shielding object.

According to the PCS 1 such as this, the positions and sizes of the vehicle detecting areas 51 and 53 can be set taking into consideration the size of the area to be focused changing depending on the traveling speed of the own vehicle or the relative speed to the shielding object. Therefore, safety can be improved.

When this configuration is used, the vehicle detecting areas 51 and 53 may be set after the shielding object is extracted. Whether or not the shielding object is positioned in the vehicle detecting areas 51 and 53 may then be determined.

In addition, in the above-described PCS 1, the collision mitigation controller 10 sets the positions and sizes of the pedestrian detecting areas 52 and 54 based on the traveling speed of the own vehicle or the relative speed to the moving object.

In such PCS 1, the positions and sizes of the pedestrian detecting areas 52 and 54 can be set taking into consideration the size of the area to be processed at an early stage regarding the moving object changing depending on the traveling speed of the own vehicle or the relative speed to the moving object. Therefore, safety can be improved.

Furthermore, in the above-described PCS 1, the collision mitigation controller 10 sets the pedestrian detecting areas 52 and 54 with reference to the position of the shielding object closest to the own vehicle, among the shielding objects within the vehicle detecting areas 51 and 53.

According to the PCS 1 such as this, collision determination can be quickly performed on the moving object that appears from behind the closest shielding object.

In addition, in the above-described PCS 1, the vehicle detecting areas 51 and 53 are set on the left side and the right side in the traveling direction of the own vehicle.

According to the PCS 1 such as this, the shielding objects and the moving objects can be detected for each vehicle detecting area 51 and 53.

Furthermore, in the above-described PCS 1, when the shielding object is extracted from the vehicle detecting area 51 on the left side, the collision mitigation controller 10 sets the pedestrian detecting area 52 on the left side in the traveling direction of the own vehicle. When the shielding object is extracted from the vehicle detecting area 53 on the right side, the collision mitigation controller 10 sets the pedestrian detecting area 54 on the right side in the traveling direction of the own vehicle.

According to the PCS 1 such as this, whether the detection position of the moving object is on the left side or the right side can be identified.

In addition, in the above-described PCS 1, when the moving object is in the shielded state, the collision mitigation controller 10 sets the amount of time required until the determination related to collision is completed to a shorter amount of time as the distance in the lateral direction from the position of the own vehicle to the position of the detected moving object becomes smaller.

According to the PCS 1 such as this, the collision can be determined at an earlier stage for a moving object that is closer to the traveling direction of the own vehicle and of which the probability of collision is high.

[Other Embodiments]

The present disclosure is not interpreted in any limited manner by the embodiment described above.

In addition, an embodiment in which a portion of the configuration according to the embodiment described above is omitted to an extent allowing the issues to be solved is also an embodiment of the present disclosure. In addition, an embodiment in which a plurality of embodiments described above are combined accordingly is also an embodiment of the present disclosure. In addition, any embodiment conceivable without departing from the essence of the disclosure identified only by the recitations in the scope of claims is also an embodiment of the present disclosure.

Furthermore, although reference numbers used in the description of the embodiment are used accordingly in the scope of claims, the reference numbers are used for the purpose of facilitating understanding of each disclosure according to the claims, and are not intended to limit the technical scope of the present disclosure according to each claim.

For example, according to the above-described embodiment, the collision mitigation controller 10 determines the pedestrian to be in the shielded state when the pedestrian is detected in the pedestrian detecting areas 52 and 54, and the position of the stopped vehicle and the position of the pedestrian are within a reference distance. However, the pedestrian may be determined to be in the shielded state when the pedestrian is detected in the pedestrian detecting areas 52 and 54.

In addition, according to the above-described embodiment, the range over which image processing is performed on the image captured by the camera sensor 31 and the range over which the radar sensor 32 performs scanning are not specified. Therefore, the scanning range may be set to an arbitrary range, such as the entire area. However, in particular, the range over which a target object is extracted may be limited to the vehicle detecting areas 51 and 53 and the pedestrian detecting areas 52 and 54. As a result, processing load for extraction of the target object can be reduced.

In addition, according to the present embodiment, a configuration is given in which recognition accuracy of the target object is improved by use of both the camera sensor 31 and the radar sensor 32. However, the present embodiment can also be actualized by a configuration that includes either of the camera sensor 31 and the radar sensor 32.

Furthermore, in the above-described PCS 1, the collision mitigation controller 10 sets the pedestrian detecting areas 52 and 54 to be maintained from when the shielding object is extracted until the own vehicle passes the pedestrian detecting areas 52 and 54. However, the pedestrian detecting areas 52 and 54 may be maintained until the elapse of a moving object extraction time set in advance.

According to the PCS 1 such as this, even when the pedestrian detecting areas 52 and 54 move with the elapse of time, the pedestrian detecting areas 52 and 54 set in the past can be maintained until the moving object extraction time has elapsed. Therefore, collision determination can be quickly performed on a moving object that is detected in these areas.

Figure 7:
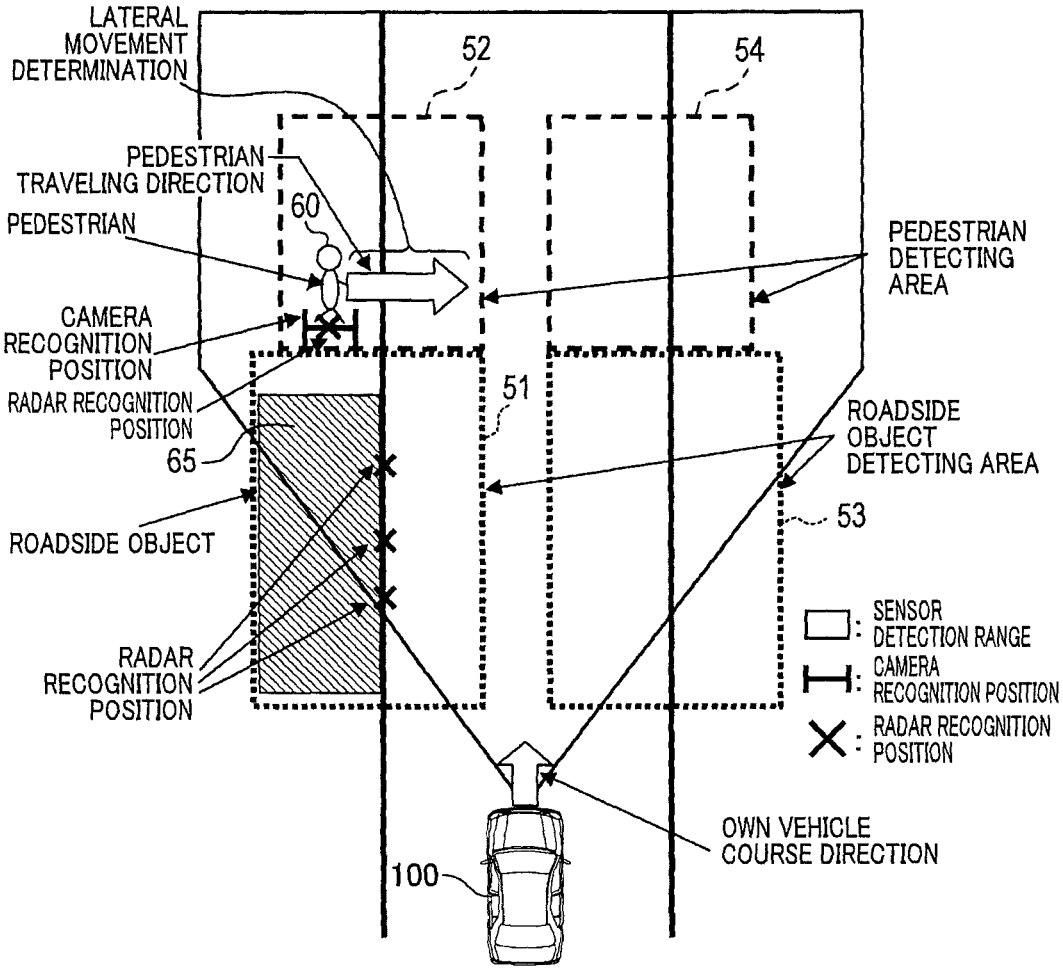
FIG. 7 is a bird's-eye view of the vehicle detecting areas and the pedestrian detecting areas according to a variation example.

In addition, for example, as shown in FIG. 7, the above-described PCS 1 may set the pedestrian detecting areas 52 and 54 for a shielding object (a roadside object 65), such as a building or a tree, that may shield the moving object, such as a pedestrian 60 or a bicycle, rather than a vehicle.

The PCS 1 is equivalent to a collision mitigation device of the exemplary embodiment. The collision mitigation controller 10 is equivalent to a collision determination device of the exemplary embodiment. The processing operation at step S120 is equivalent to collision estimating means of the exemplary embodiment. The processing operations at steps S130 to S150 are equivalent to collision avoiding means of the exemplary embodiment.

Furthermore, the processing operations at steps S200 to S220 are equivalent to specific area setting means of the exemplary embodiment. The processing operations at steps S240 and S260 are equivalent to moving object extraction area setting means or pedestrian area setting means of the exemplary embodiment. The processing operations at steps S230 and S250 are equivalent to shielding object extracting means of the exemplary embodiment.

Furthermore, the processing operations at steps S310 and S350 are equivalent to setting changing means of the exemplary embodiment. The processing operations at steps S210 to S290, S330, S340, and S370 are equivalent to shielding determining means of the exemplary embodiment. The processing operation at step S390 is equivalent to collision determining means of the exemplary embodiment.

The collision determination device (collision mitigation controller 10) may be applied to a collision determination program for enabling a computer to actualize the means configuring the collision determination device.

In addition, the elements of the collision determination device (collision mitigation controller 10) can be selectively combined as needed, and the elements of the collision mitigation device (PCS 1) can be selectively combined as needed. In this instance, some configurations may be omitted within the scope of the present disclosure.

What is claimed is:

1. A collision determination device that is mounted to an own vehicle and determines a probability of a collision with a moving object so as to enable an actuator capable of avoiding the collision to be actuated based on the probability of the collision, the collision determination device comprising:

image capturing means that detects a moving object within a captured image;

collision determining means that determines, after the moving object is detected within the captured image, whether or not an own vehicle will collide with the moving object;

shielding determining means that determines whether or not the moving object is in a predetermined state that relates to a shielded state where at least a first portion of the moving object appears from behind another object while a second portion of the moving object remains hidden behind the another object or a previously shielded state where at least a portion of the moving object was previously hidden behind the another object and appears from behind the another object;

setting changing means that sets a data collection time required for the collision determining means to collect data for completing a determination related to the collision to a shorter amount of time when the moving object is in the predetermined state, compared to when the moving object is not in the predetermined state; and collision avoiding means that actuates the actuator capable of controlling the own vehicle to avoid the collision based on the probability of the collision.

2. The collision determination device according to claim 1, wherein:

the collision determining means determines whether or not the own vehicle will collide with the moving object that is detected within the captured image, based on whether or not a parameter value related to a positional relationship between the moving object and the own vehicle meets a predetermined reference condition; and the setting changing means sets an amount of time required until the collision determining means completes a determination related to the collision to a shorter amount of time by relaxing the predetermined reference condition when the collision determining means determines the collision.

3. The collision determination device according to claim 2, further comprising:

shielding object extracting means that extracts a shielding object which is positioned in a specific area set as a partial area within the captured image and which is capable of shielding the moving object; and pedestrian area setting means that sets a moving object extracting area to an area in which a field of view is estimated to be shielded by the shielding object that is positioned further towards a depth direction in the captured image than the specific area from which the shielding object has been extracted, wherein the setting changing means determines that the moving object is in the predetermined state when the moving object is detected in the moving object extracting area.

4. The collision determination device according to claim 3, wherein the setting changing means determines that the moving object is in the predetermined state when the moving object is detected in the moving object extracting area during a period from when the shielding object is extracted until the own vehicle moves by a predetermined distance after the moving object has been extracted.

5. The collision determination device according to claim 3, wherein the setting changing means determines that the moving object is in the predetermined state when the moving object is detected in the moving object extracting area during a period from when the shielding object is extracted until a predetermined moving object extraction time elapses.

6. The collision determination device according to claim 3, further comprising specific area setting means that sets a position and a size of the specific area based on a traveling speed of the own vehicle or a relative speed to the shielding object.

7. The collision determination device according to claim 3, further comprising moving object extracting area setting means that sets a position and a size of the moving object extracting area based on a traveling speed of the own vehicle or a relative speed to the shielding object.

8. The collision determination device according to claim 3, wherein the pedestrian area setting means sets the moving object extracting area with reference to a position of a shielding object closest to the own vehicle, among the shielding object within the specific area.

9. The collision determination device according to claim 3, wherein the specific area is set on a left side and a right side in the traveling direction of the own vehicle.

10. The collision determination device according to claim 9, wherein the pedestrian area setting means sets the moving object extracting area on the left side in the traveling direction of the own vehicle when the shielding object is extracted within the specific area on the left side, and sets the moving object extracting area on the right side in the traveling direction of the own vehicle when the shielding object is extracted within the specific area on the right side.

11. The collision determination device according to claim 1, further comprising:

shielding object extracting means that extracts a shielding object which is positioned in a specific area set as a partial area within the captured image and which is capable of shielding the moving object; and pedestrian area setting means that sets a moving object extracting area to an area in which a field of view is estimated to be shielded by the shielding object that is positioned further towards a depth direction in the captured image than the specific area from which the shielding object has been extracted, wherein the setting changing means determines that the moving object is in the predetermined state when the moving object is detected in the moving object extracting area.

12. The collision determination device according to claim 11, wherein the setting changing means determines that the moving object is in the predetermined state when the moving object is detected in the moving object extracting area during a period from when the shielding object is extracted until the own vehicle moves by a predetermined distance after the moving object has been extracted.

13. The collision determination device according to claim 11, wherein the setting changing means determines that the moving object is in the predetermined state when the moving object is detected in the moving object extracting area during a period from when the shielding object is extracted until a predetermined moving object extraction time elapses.

14. The collision determination device according to claim 11, further comprising specific area setting means that sets a position and a size of the specific area based on a traveling speed of the own vehicle or a relative speed to the shielding object.

15. The collision determination device according to claim 11, further comprising moving object extracting area setting means that sets a position and a size of the moving object extracting area based on a traveling speed of the own vehicle or a relative speed to the shielding object.

16. The collision determination device according to claim 11, wherein the pedestrian area setting means sets the moving object extracting area with reference to a position of a shielding object closest to the own vehicle, among the shielding object within the specific area.

17. The collision determination device according to claim 11, wherein the specific area is set on a left side and a right side in the traveling direction of the own vehicle.

18. The collision determination device according to claim 17, wherein the pedestrian area setting means sets the moving object extracting area on the left side in the traveling direction of the own vehicle when the shielding object is extracted within the specific area on the left side, and sets the moving object extracting area on the right side in the traveling direction of the own vehicle when the shielding object is extracted within the specific area on the right side.

19. The collision determination device according to claim 17, wherein when the moving object is in the predetermined state, the setting changing means sets an amount of time required until the collision determining means completes a determination related to collision to a shorter amount of time as a distance in a lateral direction from a position of the own vehicle to a position of the detected moving object becomes smaller.

20. The collision determination device according to claim 1, wherein:

the collision determining means that determines, after a moving object is detected within a captured image, whether or not an own vehicle will collide with the moving object based on a moving history of the moving object during a predetermined period, and when the moving object is in the predetermined state, sets the predetermined period to be shorter compared to when the moving object is not in the predetermined state.

21. A collision mitigation device that is mounted to an own vehicle and mitigates collision damages when a probability of a collision of the own vehicle with a moving object is greater than a predetermined threshold, the collision mitigation device comprising:

collision estimating means that estimates a probability of a collision of the own vehicle with a moving object; and collision avoiding means that actuates an actuator capable of controlling the own vehicle to avoid the collision when the probability of the collision is higher than the predetermined threshold, wherein the collision estimating means is configured as a collision determination device that is mounted to an own vehicle and determines the probability of the collision with a moving object, the collision determination device comprising image capturing means that detects the moving object within a captured image;

collision determining means that determines, after the moving object is detected within the captured image, whether or not the own vehicle will collide with the moving object;

shielding determining means that determines whether or not the moving object is in a predetermined state that relates to a shielded state where at least a first portion of the moving object appears from behind another object while a second portion of the moving object remains hidden behind the another object or a previously shielded state where at least a portion of the moving object was previously hidden behind the another object and appears from behind the another object, and setting changing means that sets a data collection time required for the collision determining means to collect data for completing a determination related to the collision to a shorter amount of time when the moving object is in the predetermined state, compared to when the moving object is not in the predetermined state.

22. The collision mitigation device according to claim 21, wherein the collision determining means that determines, after a moving object is detected within a captured image, whether or not an own vehicle will collide with the moving object based on a moving history of the moving object during a predetermined period, and when the moving object is in the predetermined state, sets the predetermined period to be shorter compared to when the moving object is not in the predetermined state.

* * * * *